US012590425B2

(12) United States Patent
Yang et al.

(10) Patent No.: US 12,590,425 B2
(45) Date of Patent: Mar. 31, 2026

(54) INTELLIGENT REINFORCING SUPPORT FOR REINFORCED CONCRETE LOW-BOX GIRDERS AND METHOD FOR MINIMALLY INVASIVE REINFORCEMENT

(71) Applicant: SHANDONG UNIVERSITY, Jinan (CN)

(72) Inventors: Zeying Yang, Jinan (CN); Kang Duan, Jinan (CN); Youzhi Wang, Jinan (CN); Chenghe Wang, Jinan (CN); Rongrong Duan, Jinan (CN); Zhilin Qu, Jinan (CN); Yinglin Sun, Jinan (CN); Weisong Qu, Jinan (CN); Qianyi Yang, Jinan (CN); Jianbo Qu, Jinan (CN); Zhengquan Cheng, Jinan (CN); Rui Sun, Jinan (CN); Chuanlong Bi, Jinan (CN); Jie Liu, Jinan (CN); Guangtong Zhou, Jinan (CN)

(73) Assignee: SHANDONG UNIVERSITY, Jinan (CN)

( * ) Notice: Subject to any disclaimer, the term of this patent is extended or adjusted under 35 U.S.C. 154(b) by 782 days.

(21) Appl. No.: 18/009,446

(22) PCT Filed: Mar. 16, 2022

(86) PCT No.: PCT/CN2022/081232
§ 371 (c)(1),
(2) Date: Dec. 9, 2022

(87) PCT Pub. No.: WO2023/123692
PCT Pub. Date: Jul. 6, 2023

(65) Prior Publication Data

US 2024/0301636 A1 Sep. 12, 2024

(30) Foreign Application Priority Data

Dec. 31, 2021 (CN) ..... 202111677915.2

(51) Int. Cl.
*E01D 2/04* (2006.01)
*E01D 19/12* (2006.01)
*E01D 101/26* (2006.01)

(52) U.S. Cl.
CPC ..... *E01D 2/04* (2013.01); *E01D 19/12* (2013.01); *E01D 2101/268* (2013.01)

(58) Field of Classification Search
CPC ..... E01D 2/04; E01D 19/12; E01D 2101/268; E21D 15/14; E21D 15/20
(Continued)

(56) References Cited

U.S. PATENT DOCUMENTS

2012/0148350 A1* 6/2012 Poulson ..... E21D 15/586 405/290
2015/0147122 A1* 5/2015 Faulkner ..... E21D 15/55 405/288
2021/0101869 A1* 4/2021 Rachwal ..... C07D 235/04

FOREIGN PATENT DOCUMENTS

CN 204292602 U 4/2015
CN 209657522 U 11/2019
(Continued)

OTHER PUBLICATIONS

Oct. 10, 2022 Search Report issued in International Patent Application No. PCT/CN2022/081232.
(Continued)

*Primary Examiner* — Raymond W Addie
(74) *Attorney, Agent, or Firm* — OLIFF PLC.

(57) ABSTRACT

An intelligent reinforcing support for reinforced concrete low-box girder and method for minimally invasive reinforcement, including first main body, second main body, one-way rotation support structure, one-way lifting structure and control device; first and second main bodies arranged up and down, first main body used to transfer load on bridge deck to second main body, second main body used to
(Continued)

transfer load to bottom plate, lower part of first main body inserted into second main body and matched with second main body through one-way lifting structure; outer wall of upper part of first main body and outer wall of second main body respectively provided with one-way rotation support structure and automatic lock, automatic lock connected to lock catch of corresponding one-way rotation support structure, communicated with control device, automatic lock unlocks after receiving instruction, supporting rod of first main body moves upwards, supporting rod of second main body moves downwards.

10 Claims, 6 Drawing Sheets

(58) Field of Classification Search
USPC ..... 14/78; 405/288, 290, 294
See application file for complete search history.

(56) References Cited

FOREIGN PATENT DOCUMENTS

| | | | | | |
|---|---|---|---|---|---|
| CN | 213865220 | U | | 8/2021 | |
| CN | 214366127 | U | | 10/2021 | |
| CN | 214995968 | U | | 12/2021 | |
| CN | 119288560 | A | * | 1/2025 | ..... E21D 15/502 |
| CN | 120159475 | A | * | 6/2025 | ..... E21D 15/54 |
| DE | 202020002405 | U1 | * | 7/2020 | ..... E21D 15/581 |
| JP | 2013-70508 | A | | 4/2013 | |
| JP | 2021-143487 | A | | 9/2021 | |

OTHER PUBLICATIONS

Oct. 10, 2022 Written Opinion issued in International Application No. PCT/CN2022/081232.
Dec. 31, 2021 Search Report issued in Chinese Application No. 2021116779152.

* cited by examiner

INTELLIGENT REINFORCING SUPPORT FOR REINFORCED CONCRETE LOW-BOX GIRDERS AND METHOD FOR MINIMALLY INVASIVE REINFORCEMENT

CROSS-REFERENCES TO RELATED APPLICATIONS

This application claims priority benefits to Chinese Patent Application No. 202111677915.2, filed 31 Dec. 2021, the contents of which are incorporated herein by reference.

TECHNICAL FIELD

The present invention belongs to the field of bridge engineering, and particularly relates to an intelligent reinforcing support for reinforced concrete low-box girders used for reinforcing an old bridge and a method for minimally invasive reinforcement.

BACKGROUND

Bridges early designed have low technical standards, poor traffic capacity and technical conditions, and low design load standards. After years of frequent operation of heavy traffic, there are generally problems such as aging and serious decline, and most of these bridges are now in a state of "working with sick". Because of their present poor technical condition and low bearing capacity, these bridges cannot meet the needs of current transportation, thus forming the "bottleneck" of highway transportation and seriously affecting the smoothness of the whole highway line. Therefore, in order to improve the traffic capacity of the road network and ensure the safe operation of the existing bridges, it is necessary to carry out technical transformation. However, due to the low box room of the old reinforced concrete low-box girder, it is not convenient for people to enter, which brings great difficulties to the internal maintenance and reinforcement construction; traditional reinforcement methods of old bridges usually include increasing section, increasing reinforcement, increasing reinforcement ratio, etc., which may increase the cross-section of concrete and the dead weight of the bridge structure.

SUMMARY

In response to the deficiencies of the prior art, the present invention aims to provide an intelligent reinforcing support for reinforced concrete low-box girders and a method for minimally invasive reinforcement, by minimally invasive drilling of the bridge deck plate and adding the intelligent reinforcing supports inside the box girders, which can effectively reduce the cracks in the web and bridge deck and improve the bridge bearing capacity without significantly increasing the dead weight of the bridge.

To achieve the above purpose, the present invention is realized by the following technical solutions.

In a first aspect, the present invention proposes an intelligent reinforcing support for a reinforced concrete low-box girder, comprising a first main body, a second main body, a one-way rotation support structure, a one-way lifting structure and a control device; the first main body and the second main body are arranged up and down, wherein the first main body is used to transfer a load on bridge deck to the second main body, and the second main body is used to transfer the load to a bottom plate, a lower part of the first main body is inserted into the second main body and is matched with the second main body through the one-way lifting structure; an outer wall of an upper part of the first main body and an outer wall of the second main body are respectively provided with the one-way rotation support structure and an automatic lock which are matched with each other, the automatic lock is connected to a lock catch of the corresponding one-way rotation support structure, and is communicated with the control device, and the automatic lock is unlocked from the lock catch after receiving the instruction, a supporting rod of the first main body moves upwards, and a supporting rod of the second main body moves downwards.

As a further technical solution, the one-way rotation support structure comprises a connecting shaft, a ratchet, a pawl, a torsion spring, and the supporting rod; a first end and a second end of the connecting shaft are horizontally mounted in supporting bases on the first main body or the second main body, respectively; the ratchet is mounted on the connecting shaft through the torsion spring, and is connected with the supporting rod; the pawls mounted on the first main body or the second main body are arranged above and below the ratchet, respectively, and are connected to the first main body or the second main body through a compression spring; the pawls fit with the ratchet.

As a further technical solution, the first end and the second end of the connecting shaft are connected to the supporting bases by means of threads.

As a further technical solution, the torsion spring is provided on a first side of the ratchet, and a first end of the torsion spring is welded to a first sleeve fixed to an outer wall of the connecting shaft, a second end of the torsion spring is stuck in a slot opened in a second sleeve welded to the ratchet.

As a further technical solution, an angle sensor is provided on a second side of the ratchet, a battery and a data uploading device are fixed on the angle sensor, and an out part of the angle sensor is fixed on the supporting base, and the angle sensor is connected to a third sleeve welded to the ratchet using a key.

As a further technical solution, the supporting rod and the ratchet are a whole, the end of the supporting rod is a hemispherical surface, and the hemispherical surface is covered with a rubber pad; the lock catch is welded on a side of the supporting rod, and the lock catch is connected with the automatic lock.

As a further technical solution, a top surface of the first main body is welded with a lifting ring.

As a further technical solution, the one-way lifting structure comprises one-way lifting teeth provided on the surface of the lower part of the first main body, a chute provided on an upper part of the second main body, a non-return shaft matched with the one-way lifting teeth is provided in the chute, and a limit lock is provided in an upper part of the chute and is inserted into the chute.

As a further technical solution, a displacement sensor is provided between the first main body and the second main body.

In a second aspect, the present invention further provides a method for minimally invasive reinforcement of a reinforced concrete low-box girder by using an intelligent reinforcing support, comprising the steps of:

- step 1: building a local area network (LAN) in a section required reinforcement construction, and connecting a handheld terminal and an intelligent reinforcing support into the LAN;
- step 2: calculating a distance from a lower end of the intelligent reinforcing support to a bottom plate of a box girder before a supporting rod at a lower part of the intelligent reinforcing support is extended;

step 3: checking whether a lock catch on the supporting rod and an automatic lock work normally, and checking whether a limit lock works normally;

step 4: opening a construction hole on a bridge deck, a diameter of the construction hole is slightly larger than a diameter of the intelligent reinforcing support;

step 5: erecting a triangle hanger around the construction hole, and lifting slowly the intelligent reinforcing support vertically into a chamber of the box girder by using the triangle hanger, so that the distance calculated in step 2 is reserved between the lowermost end of the intelligent reinforcing support and the bottom plate, and then sending an instruction by the handheld terminal to unlock the automatic lock on a second main body of the intelligent reinforcing support, so that the supporting rod at the lower part starts to rotate in one direction until the supporting rod is propped against the bottom plate and then the rotation is stopped; an angle sensor mounted on a ratchet uploads rotation angle data to monitor whether the rotation is completed; after the rotation is completed, continuing to lift the intelligent reinforcing support into the chamber, a pawl accurately locks the ratchet by the gravity of the supporting rod at the lower part of the intelligent reinforcing support; at this time the intelligent reinforcing support stands stable on the bottom plate;

step 6: sending a wireless instruction by the handheld terminal to unlock the automatic lock on the first main body, the supporting rod at an upper part of the intelligent reinforcing support rotates in one direction, monitoring whether the rotation is completed by using the rotation angle data uploaded by the angle sensor; at this time, the supporting rod is in full contact with a top plate of the box girder;

step 7: lifting the first main body, a rubber pad at the end of the supporting rod at the upper part is deformed due to the lift of the first main body, controlling the pawl to accurately lock the one-way teeth of the ratchet by utilizing the compression of the rubber pad; and step 8: arranging the intelligent reinforcing supports in the section required reinforcement construction of the bridge in a quincuncial piles type layout.

The beneficial effects of the present invention are as follows:

1. According to the present invention, proposing a method for minimally invasive reinforcement of arranging the reinforcing supports inside the reinforced concrete low-box girder, by minimally invasive drilling on the bridge deck and adding the intelligent reinforcing supports inside the box girder, effectively reducing the cracks in the web and the bridge deck and improving the bearing capacity of the bridge without significantly increasing the dead weight of the bridge.
2. According to the present invention, proposing an intelligent reinforcing support combining traditional mechanical structure with automatic control and communication technology, by using wireless transmission technology to control the extension and lifting of the intelligent reinforcing support, solving the problem that the reinforcing support cannot be extended and lifted inside the box girder inaccessible to personnel. The sensors mounted on the intelligent reinforcing support will transmit the measurement data to the handheld terminal of the operator in real time via LAN, that is, an extension state and an uplifted state of each joint of the support can be grasped by using the sensors.

BRIEF DESCRIPTION OF THE DRAWINGS

The accompanying drawings constituting a part of the present invention are used to provide a further understanding of the present invention. The exemplary examples of the present invention and descriptions thereof are used to explain the present invention, and do not constitute an improper limitation of the present invention.

Figure 1:
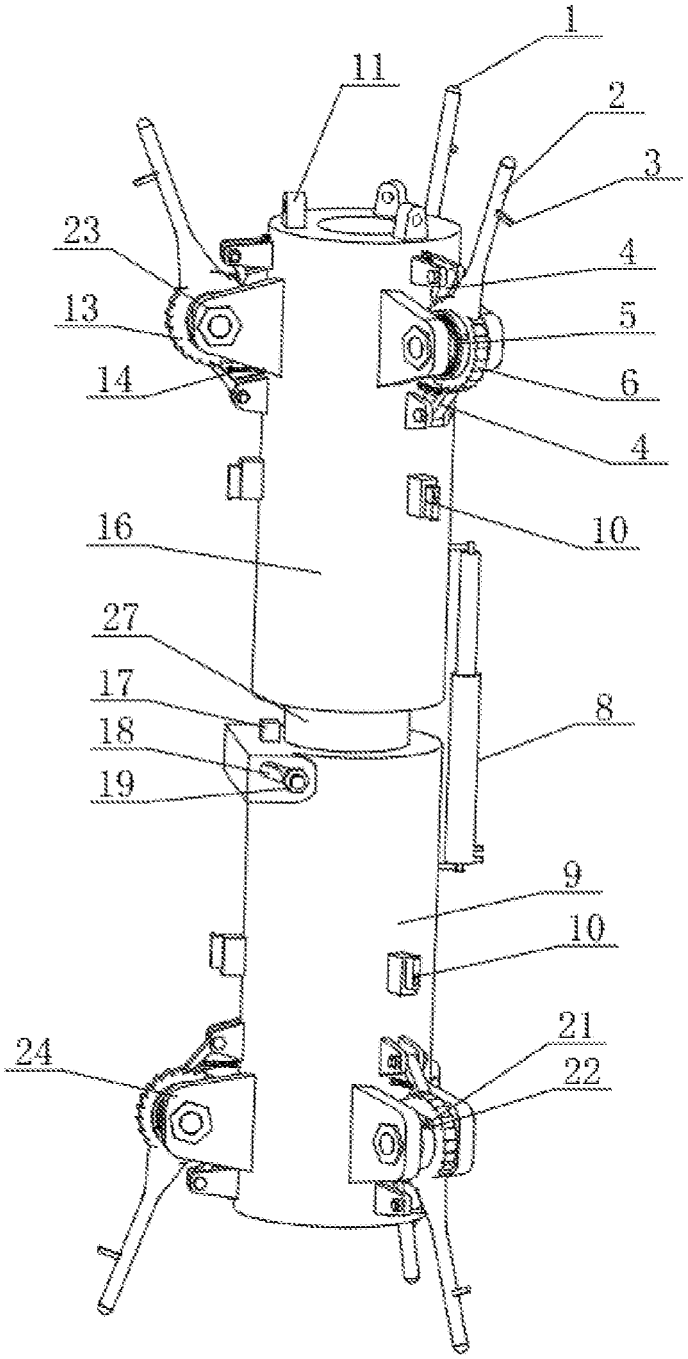
FIG. 1 is a three-dimensional view of an unfolded state of an intelligent reinforcing support of the present invention.
Figure 2:
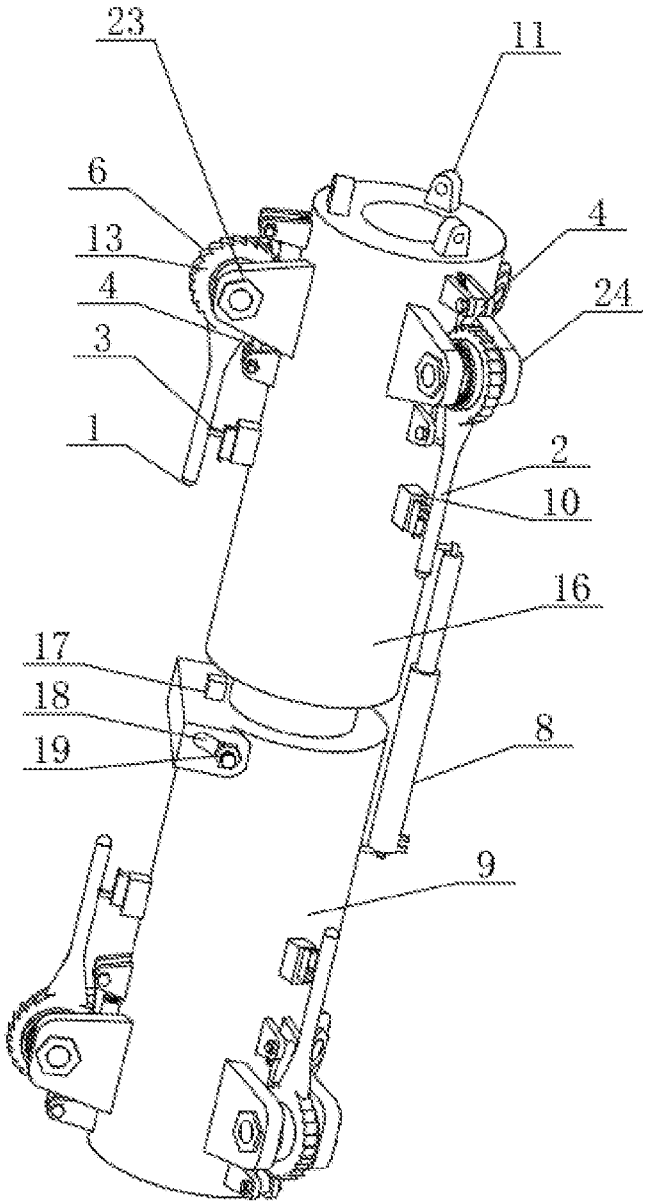
FIG. 2 is a three-dimensional view of an initial state of the intelligent reinforcing support of the present invention.
Figure 3:
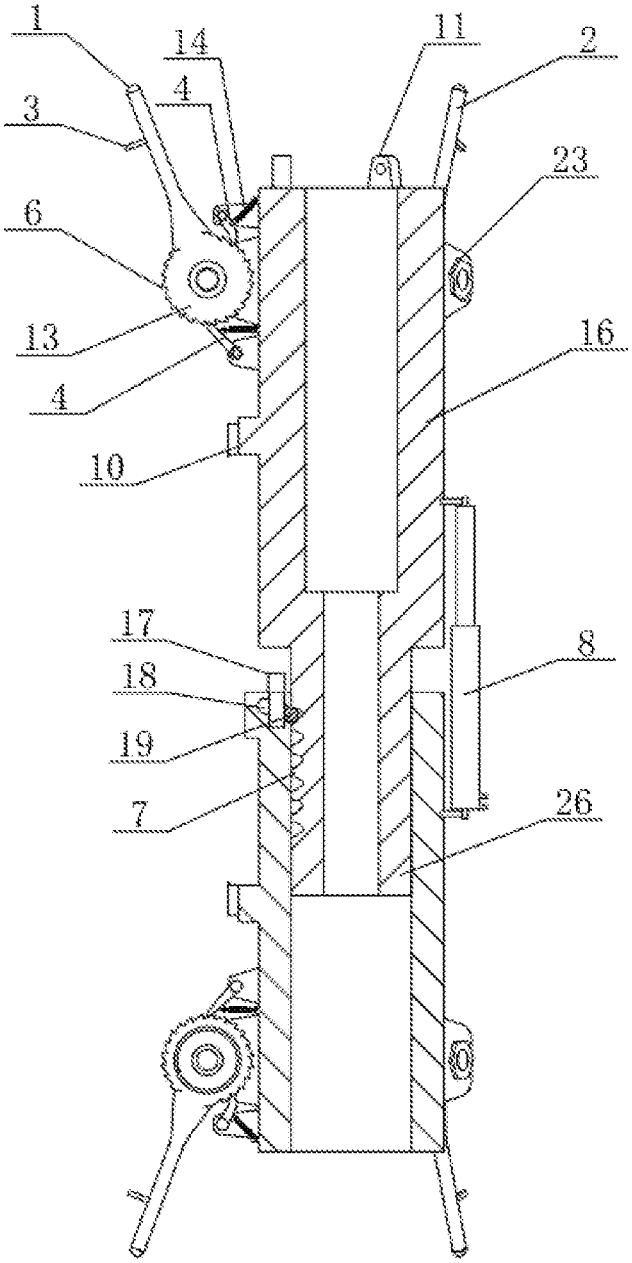
FIG. 3 is a cross-sectional view of the unfolded state of the intelligent reinforcing support of the present invention.
Figure 4:
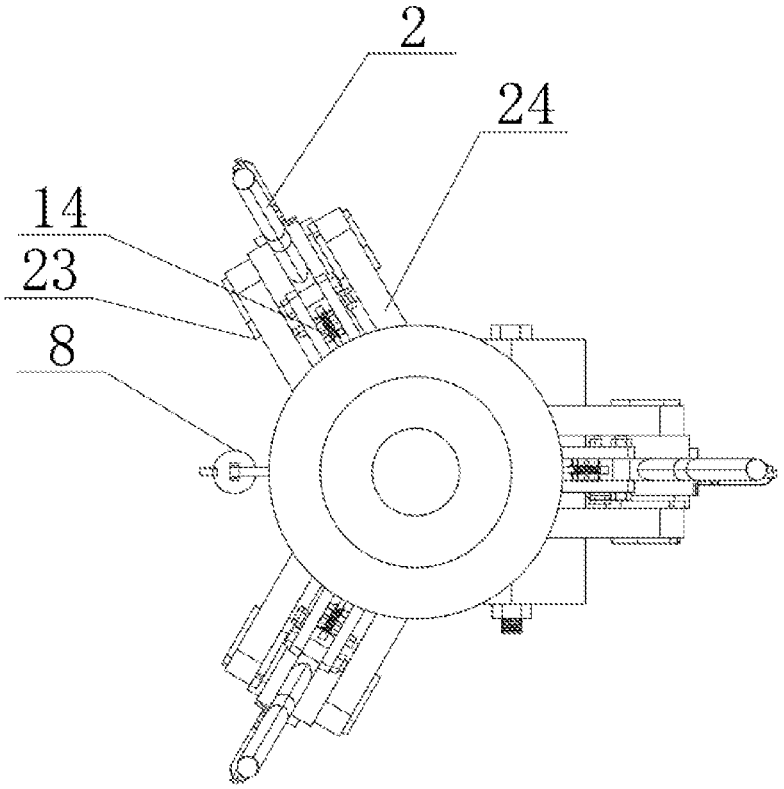
FIG. 4 is a top view of the intelligent reinforcing support of the present invention.
Figure 5:
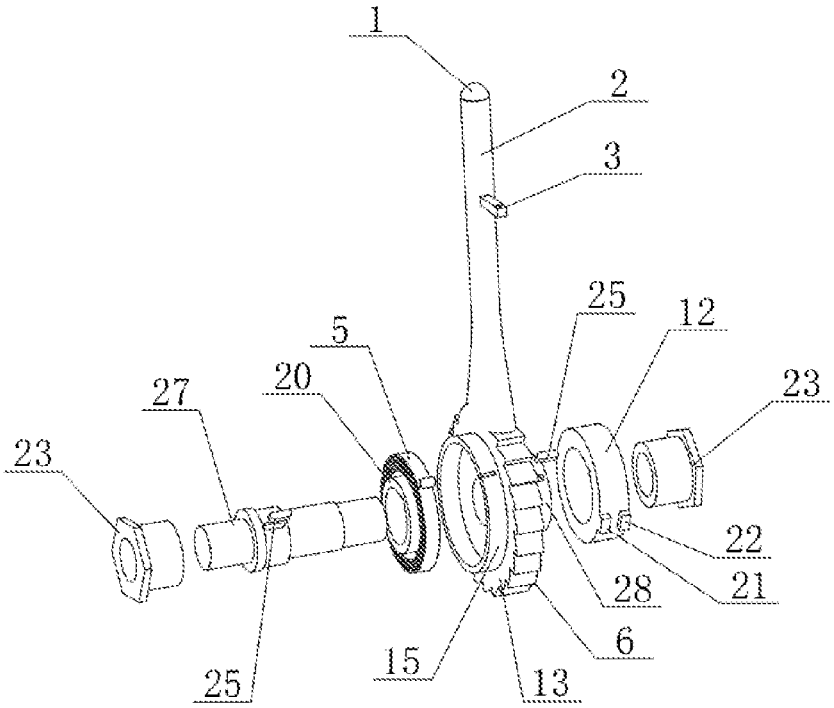
FIG. 5 is an exploded view of a one-way rotation support structure of the intelligent reinforcing support of the present invention.
Figure 6:
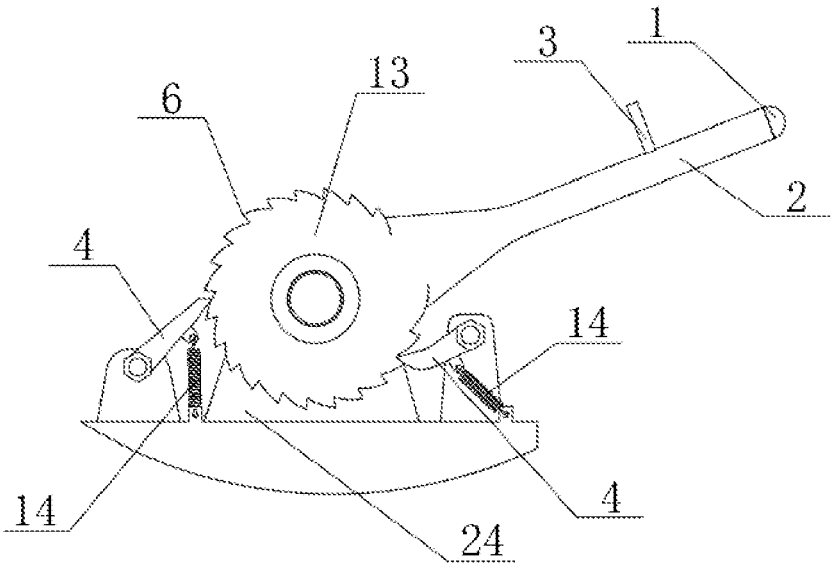
FIG. 6 is a plan view of the one-way rotation support structure of the intelligent reinforcing support of the present invention.
Figure 7:
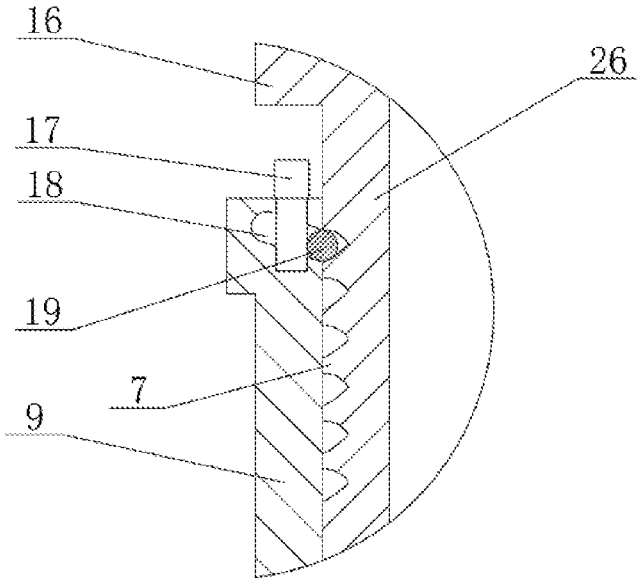
FIG. 7 is a cross-sectional view of a one-way lifting structure of the intelligent reinforcing support of the present invention.
Figure 8:
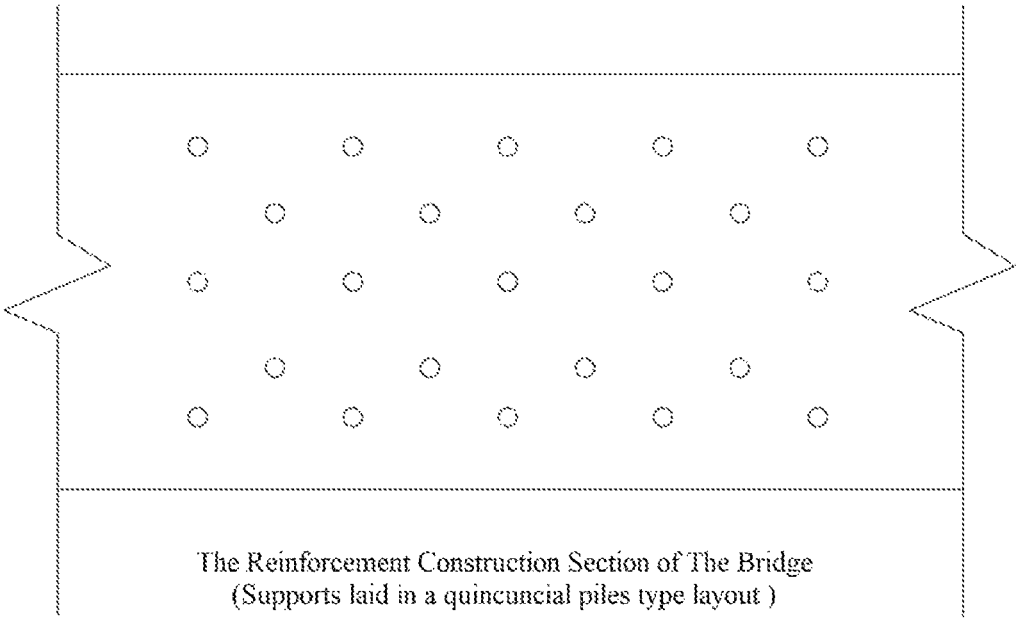
FIG. 8 is a layout drawing of a quincuncial piles type layout adopted in a method for minimally invasive reinforcement of arranging the intelligent reinforcing supports inside a reinforced concrete low-box girder.

In figures: the spacing or size between each other is exaggerated to show the position of each part, and the schematic diagram is for schematic use only; wherein, 1-rubber pad, 2-supporting rod, 3-lock catch, 4-pawl, 5-torsion spring, 6-one-way teeth, 7-one-way lifting teeth, 8-displacement sensor, 9-second main body, 10-automatic lock, 11-lifting ring, 12-angle sensor, 13-ratchet, 14-compression spring, 15-second sleeve, 16-first main body, 17-limit lock, 18-chute, 19-non-return shaft, 20-first sleeve, 21-battery, 22-data uploading device, 23-hollow threaded sleeve, 24-supporting base, 25-key, 26-lifting rod, 27-connecting shaft, 28-third sleeve.

DETAILED DESCRIPTION

It should be pointed out that the following detailed descriptions are all illustrative and are intended to provide further descriptions of the present invention. Unless otherwise specified, all technical and scientific terms used in the present invention have the same meanings as those usually understood by a person of ordinary skill in the art to which the present invention belongs.

It should be noted that the terms used herein are merely used for describing specific implementations, and are not intended to limit exemplary implementations of the present invention. As used herein, the singular form is also intended to include the plural form unless the context clearly dictates otherwise. In addition, it should further be understood that, terms "comprise" and/or "comprising" used in this specification indicate that there are features, steps, operations, devices, components, and/or combinations thereof.

For the purpose of description, if the words "upper", "lower", "left", "right" appear in this application, they only mean that they are consistent with the up, down, left and right directions of the drawings themselves, and does not limit the structure, but is only for the purpose of describing the invention and simplifying the description, and does not indicate or imply that the equipment or components referred to must have a specific orientation, be constructed and operated in a specific orientation, and therefore cannot be construed as a limitation of this application.

Explanation of terms: the terms "mounted", "connected with", "connected to", "fixed" and other terms in the present application shall be understood in a broad sense. For example, it can be a fixed connection, a detachable connection, or an integrated one; it can be a mechanical connection or an electrical connection, a direct connection or an indirect connection through an intermediate medium, an internal connection of two components, or an interactive relationship between two components. For those persons of ordinary skill in the art, the specific meaning of the above terms in the invention can be understood according to the specific situation.

As described in the background, there are deficiencies in the prior art. In order to solve the above technical problems, the present invention provides an intelligent reinforcing support for reinforced concrete low-box girders and a reinforcement method.

In an exemplary example of the present invention, as shown in FIG. 1, an intelligent reinforcing support for the reinforced concrete low-box girder comprises a first main body 16, a second main body 9, a one-way rotation support structure, a one-way lifting structure, a torsion spring 5 and a sensor, etc.

The first main body 16 is an upper structure of the intelligent reinforcing support, the second main body 9 is a lower structure of the intelligent reinforcing support, the first main body 16 is an overall circular column, which mainly transmits a load on bridge deck to the second main body 9, the second body 9 is also a circular column provided a second through hole in a direction of a central axis thereof, which mainly transmits the load from an upper part to a bottom plate. Further, the first body 16 of the present example is provided with a first through hole in the center to ensure the strength of the support while reducing the dead weight of the support.

A top surface of the first main body 16 of the present example is welded with a lifting ring for a triangle hanger lifting operation, and a diameter of a lower part of the first main body is smaller than a diameter of an upper part of the first main body, and the lower part of the first main body is inserted into the second through hole of the second main body 9.

three supporting bases 24 are provided on the side surfaces of the first main body 16 and the second main body 9 respectively, and uniformly along a circumference direction of the first main body 16 or the second main body 9; two third through holes with the same size are provided in parallel on each the supporting base 24, providing support for the one-way rotation support structure.

The one-way rotation support structure of the present example comprises a connecting shaft 27, a ratchet 13, a pawl 4, a torsion spring 5, a hollow threaded sleeve 23, a supporting rod 2, and a rubber pad 1; a first end and a second end of the connecting shaft 27, which is as a rotation axis for the one-way rotation of the ratchet, are mounted horizontally in the third through holes on the first main body and the second main body, respectively; the hollow threaded sleeves 23 are connected to the threads provided at the first end and the second end of the connecting shaft 27, so as to fix the connecting shaft to the supporting base. The torsion spring 5 provided on a first side of the ratchet 13 of the one-way rotation structure is fixed by a sleeve and a key; specifically, a first end of the torsion spring 5 is welded to a first sleeve 20 being sleeved on the connecting shaft 27 and rotating synchronously with the connecting shaft by means of the key, and a second end of the torsion spring 5 is stuck in a slot opened in a second sleeve 15 being welded to the ratchet. A diameter of the connecting shaft 27 is provided to be different in sections to restrict the position of the first sleeve and the position of the ratchet. An angle sensor 12 being a hollow angle sensor is provided on a second side of the ratchet 13 of the one-way rotation support structure, and a battery and a data uploading device are fixed on the angle sensor 12. An outer part of the angle sensor 12 is fixed to the supporting base, and a hollow shaft of the angle sensor is connected to a third sleeve 28 welded to the ratchet by means of the key. The supporting rod 2 and the ratchet 13 are as a whole, and the end of the supporting rod 2 is a hemispherical surface covered with a rubber pad 1, and a lock catch welded to a side of the supporting rod 2 is connected with an automatic lock. A hole is opened in the middle of the ratchet 13 which size is the same as a size of the corresponding position on the connecting shaft. A remaining part of the ratchet is provided with one-way sloping teeth.

The first main body and the second main body are provided with three identical one-way rotation support structures, respectively; the supporting rods of three one-way rotation support structures on the first main body may rotate from bottom to top, and the supporting rods of three one-way rotation support structures on the second main body may rotate from top to bottom. The outer sides of the first main body and the second main body are provided with three automatic locks 10, respectively; each the automatic lock 10 is connected with the lock catch fixed to the supporting rod, and after the automatic lock 10 receiving an instruction, a latch of the automatic lock is retracted and the supporting rod is rotated due to the torsional force of the torsion spring. Further, the three automatic locks on the first main body 16 are provided below the three supporting rods on the first main body, and the automatic locks on the second main body 9 are provided above the supporting rods on the second main body.

A hinged support is fixed by welding on an upper side and a lower side of each the supporting base on the first main body 16 and the second main body 9, respectively; the pawl 4 is provided on the hinged support, and the pawl 4 rides on the ratchet and is connected to a compression spring; the pawl 4 cooperates with the ratchet may make the supporting rod rotate in one direction and cannot rotate in an opposite direction.

Further, a one-way lifting structure is provided between the first main body and the second main body, and the one-way lifting structure of the present example comprises a lifting rod 26, a non-return shaft 19, a chute 18, and a limit lock 17; the lifting rod 26 is in close contact with an inner wall of the second main body 9, and the inner wall of the second main body 9 is coated with lubricant. The chute is opened at an upper end of the second main body, and the limit lock 17 is provided at an upper end of the chute; a lower part of the first main body is the lifting rod 26, the lifting rod 26 is integrally formed with the first main body and is a circular column, and the lifting rod 26 is inserted into the second main body 9 and closely contacted. A surface of the lifting rod 26 is provided with a row of the one-way lifting teeth 7, and a surface of an upper half part of each of the one-way lifting teeth 7 is an inclined surface and set at a certain angle, a surface of a lower half part of each of the one-way lifting teeth 7 is an arc surface; a tooth spacing of the one-way lifting teeth is the same as a diameter of the non-return shaft. When lifting the first main body, the one-way lifting teeth 7 lifts, the inclined plane of the one-way lifting teeth 7 makes the non-return shaft move along the chute; when the first main body rises a height of half the one-way lifting teeth, the non-return shaft reaches to the farthest end, and after the first main body then rises the height of half the one-way lifting teeth, the non-return shaft back to an original position; the non-return shaft cooperates with the one-way lifting teeth to make the first main body lift in one direction.

A working principle of the one-way lifting structure is: after the limit lock 17 is opened, the upper part of the intelligent reinforcing support is lifted, the inclined surface of the one-way lifting teeth on the lifting rod pushes the non-return shaft to roll upward, when the non-return shaft is pushed to the farthest end, a contact surface of the non-return shaft may switch to the inclined surface of the next one-way teeth; the non-return shaft reciprocates once when lifting the height of one the one-way teeth.

The operator sends instructions to the automatic lock through the built LAN.

The displacement sensor is provided outside the one-way lifting device and is responsible for monitoring the lifting displacement.

The sensor data is uploaded to the operator's handheld terminal through the built LAN.

The present example further provides a method for minimally invasive reinforcement of arranging supports in a reinforced concrete low-box girder by using the intelligent reinforcing support; according to the method, arranging the intelligent reinforcing supports by a quincuncial piles type layout in a section required reinforcement and repair of a bridge, comprising the steps of:

step 1: building a LAN in the section required reinforcement construction, and connecting a handheld terminal and wireless devices in the intelligent reinforcing support to the LAN by staff and debugging;

step 2: selecting the intelligent reinforcing support with a corresponding size according to the design information and measurement data, calculating a distance from a lower end of the intelligent reinforcing support to a bottom plate of the box girder before a supporting rod at lower part is extended;

step 3: checking whether a lock catch on the supporting rod and an automatic lock work normally, and checking whether a limit lock works normally;

step 4: opening a construction hole on a bridge deck of the section required reinforcement construction, and a diameter of the construction hole is slightly larger than a diameter of the intelligent reinforcing support, the construction holes do not damage the performance of the box girder, and the diameter thereof is controlled between 200 mm and 300 mm;

Step 5: erecting a triangle hanger around the construction hole, and lifting slowly the intelligent reinforcing support vertically into a chamber of the box girder by using the triangle hanger, reserving a distance between the lowermost end of the intelligent reinforcing support and the bottom plate, the distance is obtained by the calculation in step 2; sending a wireless instruction by the handheld terminal to unlock the three automatic locks on a second main body, so that the three supporting rods at the lower part of the intelligent reinforcing support rotates in one direction until the supporting rods are propped against the bottom plate and then stops rotating; an angle sensor provided on a ratchet uploads rotation angle data to monitor whether the rotation is completed; after the rotation is completed, continuing to lift the intelligent reinforcing support into the chamber, at this time, a pawl accurately locks one-way teeth of a ratchet by the gravity of the supporting rod, and the three supporting rods of the intelligent reinforcing support stand firmly on the bottom plate by utilizing the principle of three points to determine a plane;

Step 6: sending a wireless instruction by the handheld terminal to unlock the three automatic locks on the first main body, and the three supporting rods at the upper part of the intelligent reinforcing support rotate in one direction, monitoring whether the rotation is completed by using the rotation angle data uploaded by the angle sensor; at this time, the three supporting rods are in full contact with a top plate of the box girder, but it is not guaranteed that each the pawl can accurately lock the ratchet;

Step 7: sending a wireless instruction by the handheld terminal to unlock a limit lock, and then lifting the first main body, a rubber pad at an end of the supporting rod is deformed due to the lift of the first main body, and then controlling the pawl to accurately lock the one-way teeth of the ratchet by utilizing the compression of the rubber pad; and Step 8: arranging the intelligent reinforcing supports in the section required reinforcement construction of the bridge in a quincuncial piles type layout.

Finally, it should be noted that relational terms such as the first and the second are only used to distinguish one entity or operation from another entity or operation, and do not necessarily require or imply any such actual relationship or order between these entities or operations.

The foregoing descriptions are merely preferred embodiments of the present invention but are not intended to limit the present invention. A person skilled in art may make various alterations and variations to the present invention. Any modification, equivalent replacement, or improvement made within the spirit and principle of the present invention shall fall within the protection scope of the present invention.

What is claimed is:

1. An intelligent reinforcing support for a reinforced concrete low-box girder, comprising a first main body, a second main body, a one-way rotation support structure, a one-way lifting structure and a control device; the first main body and the second main body are arranged up and down, wherein the first main body is used to transfer a load on bridge deck to the second main body, and the second main body is used to transfer the load to a bottom plate, a lower part of the first main body is inserted into the second main body and is matched with the second main body through the one-way lifting structure; an outer wall of an upper part of the first main body and an outer wall of the second main body are respectively provided with the one-way rotation support structure and an automatic lock which are matched with each other, the automatic lock is connected to a lock catch of the corresponding one-way rotation support structure, and is communicated with the control device, and the automatic lock is unlocked from the lock catch after receiving the instruction, a supporting rod of the first main body moves upwards, and a supporting rod of the second main body moves downwards.

2. The intelligent reinforcing support for a reinforced concrete low-box girder according to claim 1, wherein the one-way rotation support structure comprises a connecting shaft, a ratchet, a pawl, a torsion spring, and the supporting rod; a first end and a second end of the connecting shaft are horizontally mounted in supporting bases on the first main body or the second main body, respectively; the ratchet is mounted on the connecting shaft through the torsion spring, and is connected with the supporting rod; the pawls mounted on the first main body or the second main body are arranged above and below the ratchet, respectively, and are connected to the first main body or the second main body through a compression spring; the pawls fit with the ratchet.

3. The intelligent reinforcing support for a reinforced concrete low-box girder according to claim 2, wherein the first end and the second end of the connecting shaft are connected to the supporting bases by means of threads.

4. The intelligent reinforcing support for a reinforced concrete low-box girder according to claim 2, wherein the torsion spring is provided on a first side of the ratchet, and a first end of the torsion spring is welded to a first sleeve fixed to an outer wall of the connecting shaft, a second end of the torsion spring is stuck in a slot opened in a second sleeve welded to the ratchet.

5. The intelligent reinforcing support for a reinforced concrete low-box girder according to claim 4, wherein an angle sensor is provided on a second side of the ratchet, a battery and a data uploading device are fixed on the angle sensor, and an out part of the angle sensor is fixed on the supporting base, and the angle sensor is connected to a third sleeve welded to the ratchet using a key.

6. The intelligent reinforcing support for a reinforced concrete low-box girder according to claim 2, wherein the supporting rod and the ratchet are a whole, the end of the supporting rod is a hemispherical surface, and the hemispherical surface is covered with a rubber pad; the lock catch is welded on a side of the supporting rod, and the lock catch is connected with the automatic lock.

7. The intelligent reinforcing support for a reinforced concrete low-box girder according to claim 1, wherein a top surface of the first main body is welded with a lifting ring.

8. The intelligent reinforcing support for a reinforced concrete low-box girder according to claim 1, wherein the one-way lifting structure comprises one-way lifting teeth provided on the surface of the lower part of the first main body, a chute provided on an upper part of the second main body, a non-return shaft matched with the one-way lifting teeth is provided in the chute, and a limit lock is provided in an upper part of the chute and is inserted into the chute.

9. The intelligent reinforcing support for a reinforced concrete low- box girder according to claim 1, wherein a displacement sensor is provided between the first main body and the second main body.

10. A method for minimally invasive reinforcement of a reinforced concrete low-box girder by using an intelligent reinforcing support of claim 1, comprising the steps of:

step 1: building a local area network (LAN) in a section required reinforcement construction, and connecting a handheld terminal and an intelligent reinforcing support into the LAN;

step 2: calculating a distance from a lower end of the intelligent reinforcing support to a bottom plate of a box girder before a supporting rod at a lower part of the intelligent reinforcing support is extended;

step 3: checking whether a lock catch on the supporting rod and an automatic lock work normally, and checking whether a limit lock works normally;

step 4: opening a construction hole on a bridge deck, a diameter of the construction hole is slightly larger than a diameter of the intelligent reinforcing support;

step 5: erecting a triangle hanger around the construction hole, and lifting slowly the intelligent reinforcing support vertically into a chamber of the box girder by using the triangle hanger, so that the distance calculated in step 2 is reserved between the lowermost end of the intelligent reinforcing support and the bottom plate, and then sending an instruction by the handheld terminal to unlock the automatic lock on a second main body of the intelligent reinforcing support, so that the supporting rod at the lower part starts to rotate in one direction until the supporting rod is propped against the bottom plate and then the rotation is stopped; an angle sensor mounted on a ratchet uploads rotation angle data to monitor whether the rotation is completed; after the rotation is completed, continuing to lift the intelligent reinforcing support into the chamber, a pawl accurately locks the ratchet by the gravity of the supporting rod at the lower part of the intelligent reinforcing support; at this time the intelligent reinforcing support stands stable on the bottom plate;

step 6: sending a wireless instruction by the handheld terminal to unlock the automatic lock on the first main body, the supporting rod at an upper part of the intelligent reinforcing support rotates in one direction, monitoring whether the rotation is completed by using the rotation angle data uploaded by the angle sensor; at this time, the supporting rod is in full contact with a top plate of the box girder;

step 7: lifting the first main body, a rubber pad at the end of the supporting rod at the upper part is deformed due to the lift of the first main body, controlling the pawl to accurately lock the one-way teeth of the ratchet by utilizing the compression of the rubber pad; and step 8: arranging the intelligent reinforcing supports in the section required reinforcement construction of the bridge in a quincuncial piles type layout.

* * * * *